US007781968B2

(12) United States Patent
Soh et al.

(10) Patent No.: US 7,781,968 B2
(45) Date of Patent: Aug. 24, 2010

(54) PLASMA DISPLAY PANEL

(75) Inventors: Hyun Soh, Suwon-si (KR); Se-Jong Kim, Suwon-si (KR); Yun-Hee Kim, Suwon-si (KR); Hyun Kim, Suwon-si (KR); Jin-Won Han, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 414 days.

(21) Appl. No.: 11/511,255

(22) Filed: Aug. 29, 2006

(65) Prior Publication Data

US 2007/0228953 A1 Oct. 4, 2007

(30) Foreign Application Priority Data

Mar. 28, 2006 (KR) ..... 10-2006-0028052

(51) Int. Cl.
*H01J 17/49* (2006.01)

(52) U.S. Cl. ..... 313/582

(58) Field of Classification Search ..... 313/582–587, 313/491

See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto (Continued)

FOREIGN PATENT DOCUMENTS

CN 1482647 3/2004

(Continued)

OTHER PUBLICATIONS

"Final Draft International Standard", Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Toan Ton
*Assistant Examiner*—Hana A Sanei
(74) *Attorney, Agent, or Firm*—Robert E. Bushnell, Esq.

(57) ABSTRACT

A Plasma Display Panel (PDP) with improved luminous efficiency includes: a rear substrate; a front substrate facing the rear substrate; a plurality of barrier ribs interposed between the front and rear substrates and partitioning a plurality of discharge cells; a plurality of sustain electrode pairs arranged separate from each other on the front substrate facing the rear substrate, each pair of sustain electrodes including an X electrode and an Y electrode; and a front dielectric layer covering the sustain electrode pairs and having at least two grooves in each of the discharge cells; a distance between the X and Y electrodes of each sustain electrode pair is greater than a height of the barrier ribs.

20 Claims, 10 Drawing Sheets

U.S. PATENT DOCUMENTS

| | | | | |
|---|---|---|---|---|
| RE37,444 | E | 11/2001 | Kanazawa | |
| 6,376,995 | B1 * | 4/2002 | Kato et al. | 315/169.3 |
| 6,407,509 | B1 * | 6/2002 | Ikeda et al. | 315/169.4 |
| 6,411,031 | B1 | 6/2002 | Ha et al. | |
| 6,445,120 | B1 | 9/2002 | Kim et al. | |
| 6,479,935 | B1 | 11/2002 | Park et al. | |
| 6,531,820 | B1 | 3/2003 | Lee et al. | |
| 6,630,916 | B1 | 10/2003 | Shinoda | |
| 6,707,436 | B2 | 3/2004 | Setoguchi et al. | |
| 2002/0047519 | A1 * | 4/2002 | Kunii et al. | 313/584 |
| 2003/0108753 | A1 | 6/2003 | Fujii et al. | |
| 2003/0146886 | A1 | 8/2003 | Amatsuchi | |
| 2003/0222580 | A1 * | 12/2003 | Amatsuchi | 313/586 |
| 2004/0212305 | A1 * | 10/2004 | Fujitani et al. | 313/586 |
| 2005/0110408 | A1 * | 5/2005 | Jang et al. | 313/582 |
| 2005/0242725 | A1 * | 11/2005 | Hasegawa et al. | 313/582 |
| 2006/0181212 | A1 * | 8/2006 | Sawa et al. | 313/582 |

FOREIGN PATENT DOCUMENTS

| | | |
|---|---|---|
| EP | 1 435 638 | 7/2004 |
| EP | 1 507 279 | 2/2005 |
| FR | 2 841 378 | 12/2003 |
| JP | 02-148645 | 6/1990 |
| JP | 2845183 | 10/1998 |
| JP | 10-321142 | 12/1998 |
| JP | 2917279 | 4/1999 |
| JP | 11-126561 | 5/1999 |
| JP | 11-297209 | 10/1999 |
| JP | 11-317172 | 11/1999 |
| JP | 2000-315459 | 11/2000 |
| JP | 2001-043804 | 2/2001 |
| JP | 2001-052618 | 2/2001 |
| JP | 2001-126625 | 5/2001 |
| JP | 2001-176405 | 6/2001 |
| JP | 2001-282185 | 10/2001 |
| JP | 2001-325888 | 11/2001 |
| JP | 2003-051262 | 2/2003 |
| JP | 2003-282008 | 10/2003 |
| JP | 2004-006307 | 1/2004 |
| JP | 2004-284934 | 10/2004 |
| JP | 2005-005189 | 1/2005 |
| JP | 2005-011743 | 1/2005 |
| JP | 2005-079052 | 3/2005 |
| JP | 2006-351517 | 12/2006 |
| WO | WO 98/43270 | 10/1998 |
| WO | WO 03/038853 | 5/2003 |
| WO | 2005/043576 | 5/2005 |

OTHER PUBLICATIONS

European Search Report corresponding to European Patent Application No. 06121505.9-2208, issued on Sep. 28, 2007.

"Japanese Office Action" issued on Mar. 17, 2009 for Applicant's corresponding Japanese Patent Application No. 2006-236641.

Office action from the Japanese Patent Office issued in Applicant's cross-referenced and corresponding Japanese patent Application No. 2006-286284 dated May 26, 2009.

Office Action from Chinese Patent Office issued in Applicant's corresponding Chinese Patent Application No. 200610142186 dated Jul. 3, 2009 and the Request for Entry of the Accompanying Office Action.

European Search Report issued in European Patent Application No. 06119872.7-2208, issued on Feb. 22, 2007.

Office action from Japanese Patent Office issued in Applicant's corresponding Japanese Patent Application No. 2006-236641 dated Nov. 4, 2009 and Request for Entry of the Accompanying Office Action attached herewith.

(Based upon foreign priority application KR10-2005-0080627).

(Based upon foreign priority application KR10-2005-0136230).

(Based upon foreign priority application KR10-2005-0136231).

Japanese Patent Office Action mailed Apr. 6, 2010 in corresponding Japanese Patent Application No. 2006-236641.

* cited by examiner

PLASMA DISPLAY PANEL

CLAIM OF PRIORITY

This application makes reference to, incorporates the same herein, and claims all benefits accruing under 35 U.S.C. §119 from an application for THE PLASMA DISPLAY PANEL earlier filed in the Korean Intellectual Property Office on the 28 of Mar. 2006 and there duly assigned Serial No. 10-2006-0028052.

BACKGROUND OF THE INVENTION

1. Field of the Invention

The present invention relates to a Plasma Display Panel (PDP), and more particularly, to a PDP with an improved luminous efficiency.

2. Description of the Related Art

Recently, Plasma Display Panels (PDPs) have come to public attention, as replacements for conventional Cathode Ray Tubes (CRTs). In a PDP, a discharge gas is injected between two substrates on which a plurality of electrodes are formed, a discharge voltage is supplied to the electrodes, a phosphor formed with a predetermined pattern is excited due to ultraviolet rays generated by the discharge voltage, and a desired image is displayed.

Various studies have been conducted to try to increase the luminous efficiency of Various studies have been conducted to try to increase the luminous efficiency of PDPs and reduce the voltage required for discharge. In other words, it is important to design a PDP which can operate at a voltage lower than a predetermined driving voltage while still having an improved luminous efficiency.

SUMMARY OF THE INVENTION

The present invention provides a Plasma Display Panel (PDP) with an improved luminous efficiency.

According to an aspect of the present invention, a Plasma Display Panel (PDP) is provided including: a rear substrate; a front substrate facing the rear substrate; a plurality of barrier ribs interposed between the front and rear substrates and partitioning a plurality of discharge cells; a plurality of sustain electrode pairs arranged separate from each other on the front substrate facing the rear substrate, each pair of sustain electrodes including an X electrode and an Y electrode; and a front dielectric layer covering the sustain electrode pairs and having at least two grooves in each of the discharge cells; a distance between the X and Y electrodes of each sustain electrode pair is greater than a height of the barrier ribs.

The grooves preferably correspond to the X and Y electrodes. Two grooves are preferably formed in each of the discharge cells, and the two grooves respectively correspond to each of the X electrodes and each of the Y electrodes. A distance between the two grooves of each discharge cell is preferably equal to or greater than the distance between the X and Y electrodes of each sustain electrode pair and preferably equal to or less than a distance between outer sides of the X and Y electrodes of each sustain electrode pair.

Each of the X electrodes preferably includes a bus electrode and a transparent electrode arranged on the bus electrode and each of the Y electrodes includes a bus electrode and a transparent electrode arranged on the bus electrode, the grooves corresponding to the transparent electrodes. Each of the X electrodes preferably includes a bus electrode and a transparent electrode arranged on the bus electrode and each of the Y electrodes includes a bus electrode and a transparent electrode arranged on the bus electrode, at least a portion of each of the grooves corresponding to each of the bus electrodes.

The grooves preferably correspond to each other in each discharge cell and are preferably symmetrical to each other with respect to a virtual plane of symmetry arranged therebetween, and preferably parallel to the X and Y electrodes of each sustain electrode pair.

The distance between the X and Y electrodes of each sustain electrode pair is preferably in a range between 110 μm and 260 μm.

The discharge cells are preferably rectangular, and the distance between the X and Y electrodes of each sustain electrode pair is preferably in a range between ¼ and ½ the length of a long side of each of the discharge cells.

The front dielectric layer preferably includes a Bi-based material. The front dielectric layer preferably includes $Bi_2O_3$. The front dielectric layer preferably includes $Bi_2O_3$, $B_2O_3$ and ZnO.

The grooves are preferably arranged intermittently in each of the discharge cells. The grooves have rectangular cross-sections. A long side of the cross-section of each of the grooves is preferably in a range between 180 μm and 240 μm. A short side of the cross-section of each of the grooves is preferably in a range between 80 μm and 120 μm.

The barrier ribs preferably respectively include first barrier-rib portions parallel to the sustain electrode pairs and second barrier-rib portions connecting the first barrier-rib portions.

Each of the X electrodes preferably includes a bus electrode and a transparent electrode arranged on the bus electrode and each of the Y electrodes includes a bus electrode and a transparent electrode arranged on the bus electrode, at least a portion of each of the bus electrodes corresponding to the first barrier-rib portions. Each of the X electrodes preferably includes a bus electrode and a transparent electrode arranged on the bus electrode and each of the Y electrodes includes a bus electrode and a transparent electrode arranged on the bus electrode, the bus electrodes being separated from the first barrier-rib portions by a predetermined distance in a direction toward a center of the discharge cells.

The PDP preferably further includes: address electrodes crossing the sustain electrode pairs and arranged on the rear substrate facing the front substrate; a rear dielectric layer covering the address electrodes and the rear substrate; and phosphor layers arranged within each discharge cell.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
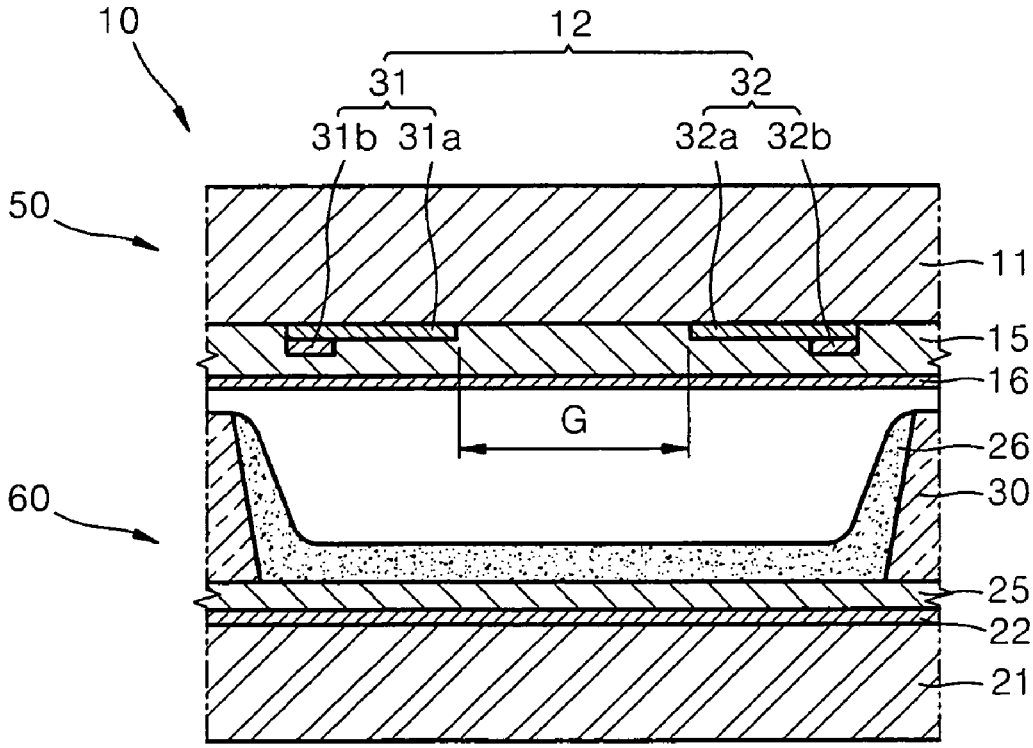
FIG. 1 is a cross-sectional view of an Alternating Current (AC) three-electrode surface discharge Plasma Display Panel (PDP)

The present invention will now be described more fully with reference to the accompanying drawings, in which exemplary embodiments of the invention are shown. The invention can, however, be embodied in many different forms and should not be construed as being limited to the embodiments set forth therein; rather, these embodiments are provided so that this disclosure will be thorough and complete, and will fully convey the concept of the present invention to those skilled in the art. Like reference numerals in the drawings denote like elements.

FIG. 1 is a cross-sectional view of an Alternating Current (AC) three-electrode surface discharge Plasma Display Panel (PDP) 10. Referring to FIG. 1, the PDP 10 includes a front panel 50 and a rear panel 60 which are coupled parallel to each other. Sustain electrode pairs 12, each composed of an X electrode 31 and a Y electrode 32, are disposed on a front substrate 11 of the front panel 50. Address electrodes 22 are disposed on a rear substrate 21 which faces the front substrate 11 and the address electrodes 22 cross the X electrodes 31 and the Y electrodes 32. Each of the X electrodes 31 includes a transparent electrode 31*a* and a bus electrode 31*b*, and each of the Y electrodes 32 includes a transparent electrode 32*a* and a bus electrode 32*b*. A unit discharge cell is a space that is formed by the crossing of each of the address electrodes 22 with each sustain electrode pair 12 that includes an X electrode 31 and a Y electrode 32. A front dielectric layer 15 and a rear dielectric layer 21 are respectively formed on the front substrate 11 and the rear substrate 21 to cover the electrodes. An MgO protective layer 16 is formed on the front dielectric layer 15, and barrier ribs 30 which partition the discharge cells and prevent cross-talk between discharge cells are formed on a front surface of the rear dielectric layer 21. Phosphor layers 26 are coated on sidewalls of the barrier ribs 30 and on a portion of the front surface of the rear dielectric layer 25 where the barrier ribs 30 are not formed.

Such a PDP 10 has a high driving voltage and low luminous efficiency.

Figure 2:
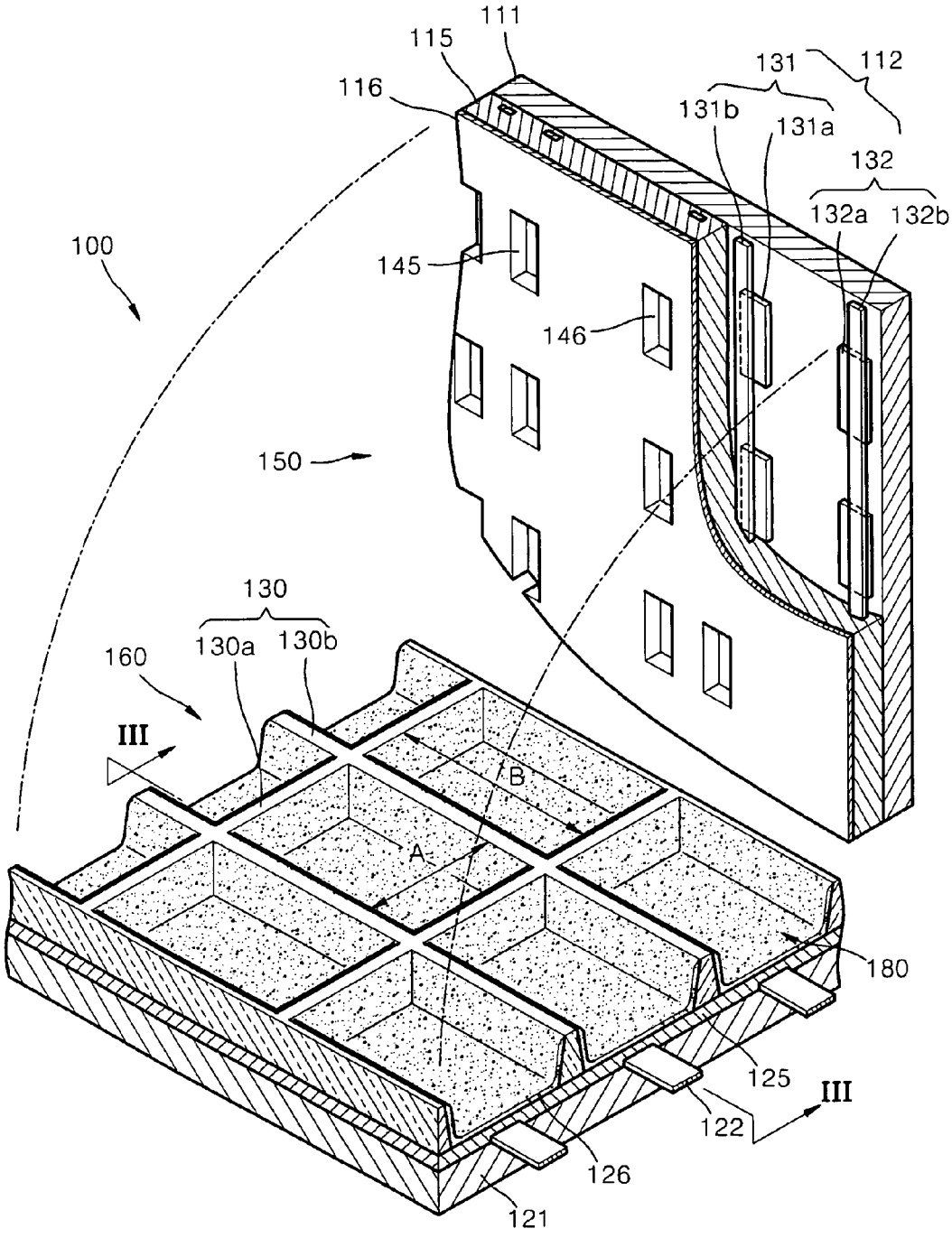
FIG. 2 is an exploded perspective view of a PDP according to an embodiment of the present invention.
Figure 3:
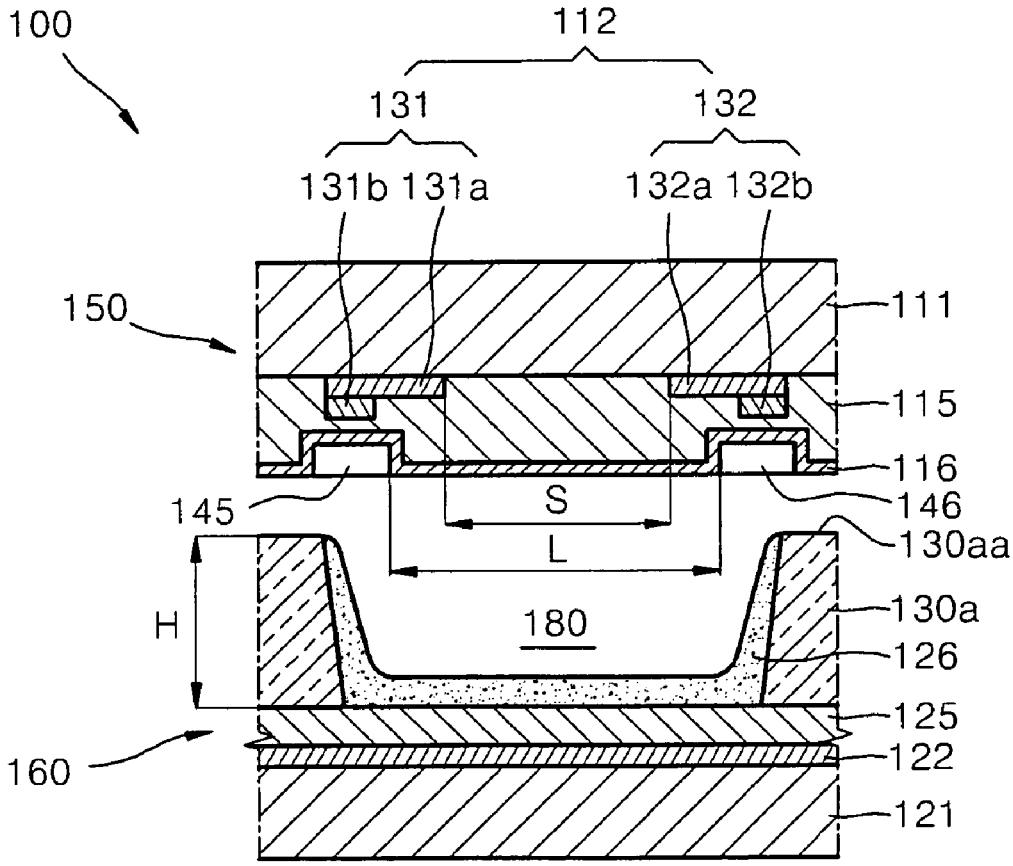
FIG. 3 is a cross-sectional view of the PDP of FIG. 2 taken along line III-III of FIG. 2, according to an embodiment of the present invention.
Figure 4:
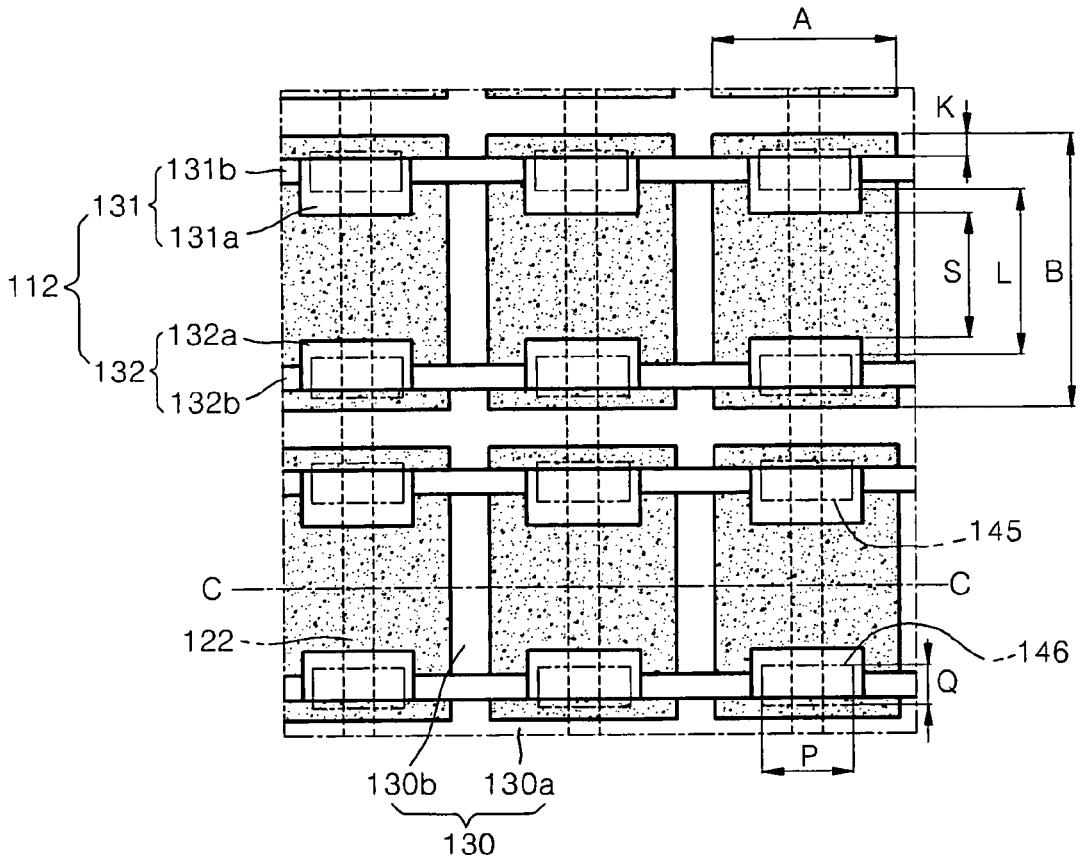
FIG. 4 is a view of a layout of the PDP of FIG. 2, illustrating arrangements of discharge cells, X, Y and address electrodes, and first and second grooves, according to an embodiment of the present invention.

FIGS. 2 through 4 are various views of a Plasma Display Panel (PDP) 100 according to an embodiment of the present invention. Specifically, FIG. 2 is an exploded perspective view of the PDP 100, and FIG. 3 is a cross-sectional view of the PDP 100 of FIG. 2 taken along line III-III of FIG. 2. In addition, FIG. 4 is a view of a layout of the PDP 100 of FIG. 2, illustrating arrangements of discharge cells 180, X, Y and address electrodes 131, 132 and 122, and first and second grooves 145 and 146.

Referring to FIG. 2, the PDP 100 includes a front panel 150 and a rear panel 160 coupled parallel to each other. The front panel 150 includes a front substrate 111, a front dielectric layer 115, sustain electrode pairs 112, and a protective layer 116. The rear panel 160 includes a rear substrate 121, address electrodes 122, a rear dielectric layer 125, barrier ribs 130 and phosphor layers 126.

The front substrate 111 and the rear substrate 121 are separated from each other by a predetermined distance and define a discharge space therebetween in which a discharge occurs. The front substrate 111 and the rear substrate 121 can be formed of glass having a high transmittance of visible light and can be colored to enhance bright-room contrast.

The barrier ribs 130 are interposed between the front and rear substrates 111 and 121. More specifically, the barrier ribs 130 are formed on the rear dielectric layer 125. The barrier ribs 130 divide the discharge space between the front and rear substrates 111 and 121 into discharge cells 180 and prevent electrical and optical cross-talk between the discharge cells 180.

Referring to FIG. 2, the barrier ribs 130 partition the discharge cells 180 which are rectangular cross sections and are arranged in a matrix pattern. The barrier ribs 130 respectively includes first barrier-rib portions 130*a* parallel to the sustain electrode pairs 112 and second barrier-rib portions 130*b* connecting the first barrier-rib portions 130*a*. Each of the discharge cells 180 is surrounded by a pair of first barrier-rib portions 130*a* facing each other and a pair of second barrier-rib portions 130*b* facing each other. Therefore, the barrier ribs 130 have a closed structure. However, the present invention is not limited to this closed structure. The barrier ribs 130 can be arranged in a closed structure such that the discharge cells 180 have polygonal (e.g., triangular or pentagonal), circular, or oval cross-sections. Alternatively, the barrier ribs 130 can be arranged in an open structure, such as in a striped pattern. The barrier ribs 130 can also partition the discharge cells 180 in a waffle or delta pattern.

Each of the discharge cells 180 has short sides A extending along a direction in which the sustain electrode pairs 112 extend and has long sides B extending along a direction perpendicular to the sustain electrode pairs 112. The long and short sides B and A surrounding each of the discharge cells 180 are defined by topmost surfaces of the first barrier-rib portions 130*a* and the second barrier-rib portions 130*b* of the barrier ribs 130.

The sustain electrode pairs 112 are disposed on the front substrate 111 facing the rear substrate 121. Each of the sustain electrode pairs 112 includes a sustain electrode pair, that is, an X electrode 131 and a Y electrode 132 used as sustain electrodes. The sustain electrode pairs 112 are separated from each other by a predetermined distance and are arranged parallel to each other on the front substrate 111.

The X electrode 131 functions as a sustain electrode and the Y electrode 132 functions as a scan electrode. In the present embodiment, the sustain electrode pairs 112 are disposed directly on the front substrate 111. However, the sustain electrode pairs 112 can be arranged differently. For example, the sustain electrode pairs 112 can be separated by a predetermined distance in a direction from the front substrate 111 toward the rear substrate 121.

Figure 5A:
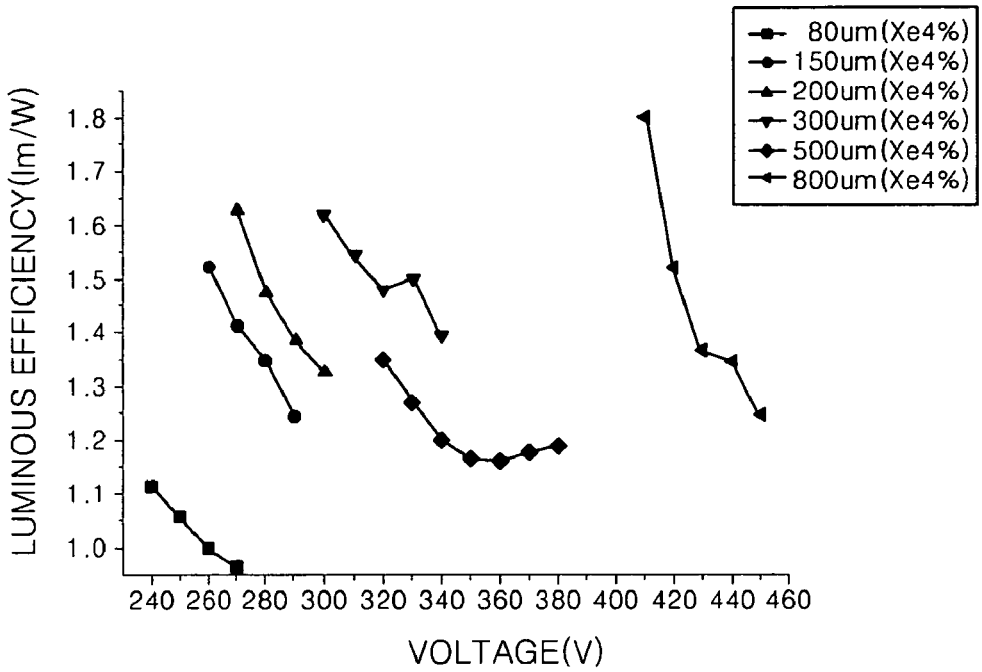
FIGS. 5A and 5B are graphs of a relationship between driving voltage and luminous efficiency of the PDP of FIG. 1 measured using a variety of values for a distance between X electrodes and Y electrodes of each sustain electrode pair.
Figure 5B:
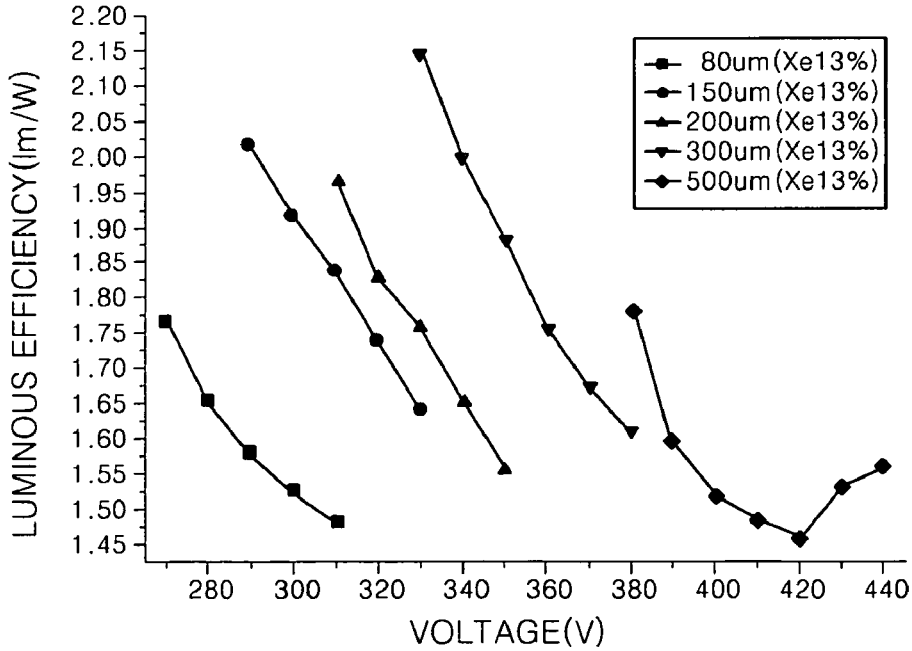

FIGS. 5A and 5B are graphs of a relationship between driving voltage and luminous efficiency of the PDP 10 of FIG. 1 measured using a variety of values for a distance G between the X electrode 31 and the Y electrode 32 of each sustain electrode pair 12. Specifically, FIG. 5A is a graph of the relationship between driving voltage and luminous efficiency of the PDP 10 measured when the discharge gas of the PDP 10 is 4 percent Xe. FIG. 5B is a graph of the relationship between driving voltage and luminous efficiency of the PDP 10 measured when the discharge gas of the PDP 10 is 13 percent Xe. In addition, in FIG. 5A, the driving voltage and luminous efficiency of the PDP 10 were measured when the distance G between the X electrode 31 and the Y electrode 32 of each sustain electrode pair 12 was 80 μm, 150 μm, 200 μm, 300 μm, 500 μm, and 800 μm. In FIG. 5B, the driving voltage and luminous efficiency of the PDP 10 were measured when the distance G between the X electrode 31 and the Y electrode 32 of each sustain electrode pair 12 was 80 μm, 150 μm, 200 μm, 300 μm, and 500 μm.

Referring to FIGS. 5A and 5B, as the distance G between the X electrode 31 and the Y electrode 32 of each sustain electrode pair 12 increases, the luminous efficiency of the PDP 10 also increases. In addition, as the distance G increases, a distance between the address electrodes 22 and the X and Y electrodes 31 and 32 becomes more similar to the distance G. When a discharge is initiated and sustained, a diffusion discharge occurs between the X, Y and address electrodes 31, 32 and 22. Therefore, the discharge not only occurs in the front panel 50 but also spreads to the rear panel 60, thereby improving the luminous efficiency of the PDP 10. In this regard, the distance G between the X electrode 31 and the Y electrode 32 of each sustain electrode pair 12 must be increased to improve the luminous efficiency of the PDP 10.

It can be seen from the graphs of FIGS. 5A and 5B that the driving voltage also increases as the distance G between the X electrode 31 and the Y electrode 32 of each sustain electrode pair 12 increases. In other words, when a constant voltage is supplied between the X electrode 31 and the Y electrode 32 and the distance G is increased, an amount of electric charges accumulated between the X electrode 31 and the Y electrode 32 of each sustain electrode pair 12 reduces. As a result, the capacitance of the PDP 10 is reduced and a high sustain voltage is therefore required for an active discharge between the X electrode 31 and the Y electrode 32 of each sustain electrode pair 112.

In this regard, in the current embodiment of the present invention, a distance S between the X electrode 131 and the Y electrode 132 of each sustain electrode pair 112 is made greater than a height H of the barrier ribs 130 to enhance the luminous efficiency of the PDP 100. In this case, referring to FIGS. 5A and 5B, the distance S between the X electrode 131 and the Y electrode 132 of each sustain electrode pair 112 can be between 110 μm and 260 μm to prevent the driving voltage from exceeding a predetermined voltage (for example, approximately 300 V). The distance S between the X electrode 131 and the Y electrode 132 of each sustain electrode pair 112 can be between ¼ and ½ of the long sides B of the discharge cells 180.

Referring back to FIG. 4, each of the X electrodes 131 includes a transparent electrode 131*a* and a bus electrode 131*b*, and each of the Y electrodes 132 includes a transparent electrode 132*a* and a bus electrode 132*b*. The transparent electrodes 131*a* and 132*a* are formed of a transparent conductive material, such as Indium Tin Oxide (ITO), which can generate a discharge and transmit light emitted from the phosphor layers 126 to the front substrate 111. However, large voltage drops occur along the transparent electrodes 131*a* and 132*a* when formed of ITO. Therefore, a high driving voltage is required and the response time of the PDP 100 is long. To solve these problems, the bus electrodes 131*b* and 132*b* formed narrowly of metal are disposed on the transparent electrodes 131*a* and 132*a*. The bus electrodes 131*b* and 132*b* can be a single layer formed of metal, such as Ag, Al or Cu, or can be a plurality of layers. The transparent electrodes 131*a* and 132*a* and the bus electrodes 131*b* and 132*b* can be formed using photo-etching or photo-lithography.

The shapes and arrangements of the X electrode 131 and the Y electrode 132 of each sustain electrode pair 112 are described in more detail as follows with reference to FIG. 4. The bus electrodes 131*b* and 132*b* are separated from each other by a predetermined distance and are arranged parallel to each other in each of the discharge cells 180. The bus electrodes 131*b* and 132*b* cross the discharge cells 180 disposed along one direction. In particular, the bus electrodes 131*b* and 132*b* are arranged a predetermined distance K from the edge of the first barrier-rib portions 130*a* towards the center of the discharge cells 180.

As described above, the transparent electrodes 131*a* and 132*a* are respectively electrically connected to the bus electrodes 131*b* and 132*b*. The rectangular transparent electrodes 131*a* and 132*a* are intermittently disposed in each of the discharge cells 180. A lateral portion of each of the transparent electrodes 131*a* and 132*a* is connected to each of the bus electrodes 131*b* and 132*b*, and the other portion of each of the transparent electrodes 131*a* and 132*a* faces the center of the discharge cells 180.

Figure 6:
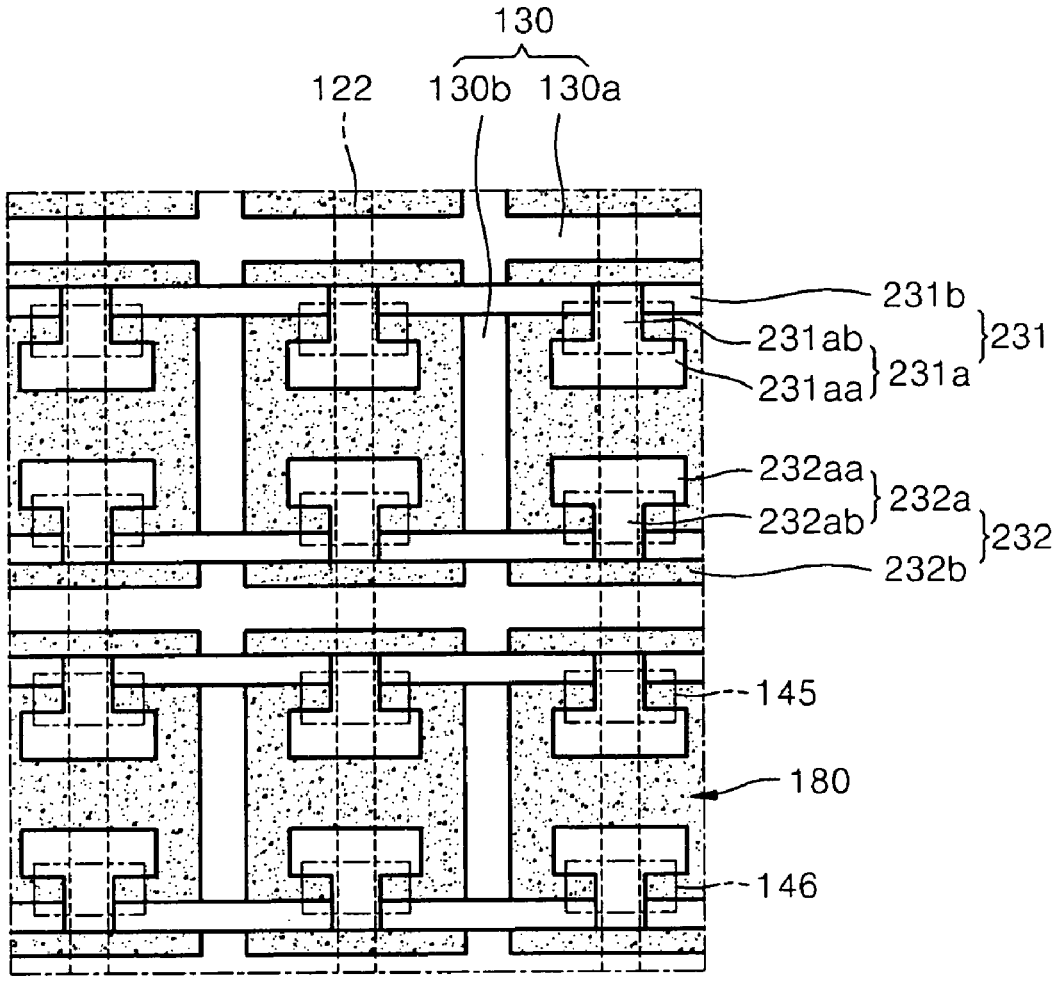
FIG. 6 is a view of a layout of a first modified version of the PDP of FIG. 2 according to another embodiment of the present invention.

The transparent electrodes 131*a* and 132*a* can have various shapes. FIG. 6 is a view of a layout of a first modified version of the PDP 100 according to another embodiment of the present invention. Referring to FIG. 6, X electrodes 231 and Y electrodes 232 are arranged in a hammer pattern. Each of the X electrodes 231 includes a transparent electrode 231*a* and a bus electrode 231*b*, and each of the Y electrodes 232 includes a transparent 232*a* and a bus electrode 232*b*. Each of the transparent electrodes 231*a* includes a discharge portion 231*aa* separated from each of the bus electrodes 231*b* of the X electrodes 231 toward the center of the corresponding discharge cell 180 and a connection portion 231*ab* connecting the discharge portion 231*aa* to each of the bus electrodes 231*b* of the X electrodes 231. In addition, each of the transparent electrodes 232*a* of the Y electrodes 232 includes a discharge portion 232*aa* separated from each of the bus electrodes 232*b* of the Y electrodes 232 toward the center of the corresponding discharge cell 180 and a connection portion 232*ab* connecting the discharge portion 232*aa* to each of the bus electrodes 232*b* of the Y electrodes 232. A discharge voltage of the PDP 100 can be reduced since the discharge portions 231*aa* and 232*aa* of the X and Y electrodes 231 and 232 are separated by only a small gap. In addition, visible light transmission can be improved since the overall size of the transparent electrodes 231*a* and 232*a* can be reduced.

Referring to FIGS. 2 and 3, the front dielectric layer 115 is formed on the front substrate 111 to cover the sustain electrode pairs 112. The front dielectric layer 115 prevents the adjacent X electrode 131 and the Y electrode 132 of each sustain electrode pair 112 from being electrically connected to each other and prevents charged particles or electrons colliding directly with, and thus damaging, the X electrode 131 and the Y electrode 132 of each sustain electrode pair 112. In addition, the front dielectric layer 115 induces electric charges.

Referring to FIGS. 2 through 4, first and second grooves 145 and 146 are formed to a predetermined depth in the front dielectric layer 115. The depths of the first and second grooves 145 and 146 are determined taking into account the possibility of damage to the front dielectric layer 115 caused by a plasma discharge, the disposition of wall charges, the size of a discharge voltage, and so on.

One first groove 145 and one second groove 146 correspond to each discharge cell 180. Since the overall thickness of the front dielectric layer 115 is reduced by the first and second grooves 145 and 146, the visible light transmitted can be increased. In the present embodiment, the first and second grooves 145 and 146 have rectangular cross sections. However, the present invention is not limited to rectangular cross sections. The first and second grooves 145 and 146 can be formed having variously shaped cross-sections. In the present embodiment, long sides P of the cross sections of the first and second grooves 145 and 146, as shown in FIG. 4, can be between 180 μm and 240 μm, and short sides Q of the cross sections of the first and second grooves 145 and 146, as shown in FIG. 4, can be between 80 μm and 120 μm. The first and second grooves 145 and 146 can be symmetrical according to a virtual symmetry plane C-C located between the X electrode 131 and the Y electrode 132 of each discharge cell 180.

Each of the first grooves 145 corresponds to a portion of each of the bus electrodes 131*b* of the X electrodes 131 and a portion of each of the transparent electrodes 131*a* of the X electrodes 131 and extends in the direction outward from the center of each of the discharge cells 180. Similarly, each of the second grooves 146 corresponds to a portion of each of the transparent electrodes 132*a* of the Y electrodes 132 and a portion of each of the bus electrodes 132*b* of the Y electrodes 132 and extends in the direction outward from the center of each of the discharge cells 180. However, the first grooves 145 can be formed at various locations. For example, the first grooves 145 can or cannot correspond to the transparent electrodes 131*a*. Likewise, the second grooves 146 can be formed at various locations.

The first and second grooves 145 and 146 can be formed using various methods. For example, the first and second grooves 145 and 146 can be formed by spreading a dielectric material on the front substrate 111 and then etching the first and second grooves 145 and 146 out of the front substrate 111. This method is not only cost-saving but also simple. A dielectric material generally used for PDPs is a Pb-based lead borosilicate composite $PbO—B_2O_3—SiO_2$. The dielectric material contains more than a sufficient level of $SiO_2$ to control the dielectric constant of the dielectric material, a coefficient of thermal expansion of the dielectric material, and reactivity of the dielectric material with the bus electrodes 132*a* and 132*b*. The dielectric material containing Pb is harmful to humans. To address this problem, the front dielectric layer 115 can contain a Bi-based material, and the Bi-based material may contain $Bi_2O_3$. Therefore, the front dielectric layer 115 can be formed of $Bi_2O_3—B_2O_3—ZnO$.

The front dielectric layer 115 is covered by the protective layer 116. During a plasma discharge, the protective layer 116 prevents charged particles and electrons from colliding with, and thus damaging, the front dielectric layer 115. The protective layer 116 also emits a large amount of secondary electrons to facilitate a smooth plasma discharge. The protective layer 116 performing these functions is formed of a material having a high secondary electron emission coefficient and excellent visible light transmittance. The protective layer 116 is formed as a thin film using a sputtering method or an electron beam deposition method after the front dielectric layer 115 is formed.

The address electrodes 122 are disposed on the rear substrate 121 facing the front substrate 111. The address electrodes 122 extend across the discharge cells 180 and cross the X electrode 131 and the Y electrode 132 of each sustain electrode pair 112.

The address electrodes 122 are used to generate an address discharge for facilitating a sustain discharge between the X electrode 131 and the Y electrode 132 of each sustain electrode pair 112. More specifically, the address electrodes 122 lower the voltage required to generate the sustain discharge. The address discharge occurs between the Y electrodes 132 and the address electrodes 122.

The rear dielectric layer 125 is formed on the rear substrate 121 to cover the address electrodes 122. The rear dielectric layer 125 is formed of a dielectric material which can prevent charged particles or electrons from colliding with, and thus damaging, the address electrodes 122 during discharge and, at the same time, can induce electric charges. An example of such a dielectric material is a $Bi_2O_3—B_2O_3—ZnO$ composite.

The red, green or blue phosphor layers 126, according to the required color of the discharge cell 180, are formed on an inward facing sidewall of each of the barrier ribs 130 and a portion of a front surface of the rear dielectric layer 125 on which the barrier ribs 130 are not formed. The phosphor layers 126 include a phosphor material that can absorb ultraviolet rays and consequently emit visible light. Specifically, a red phosphor layer includes a phosphor material such as $Y(V,P)O_4$:Eu, a green phosphor layer includes a phosphor material such as $Zn_2SiO_4$:Mn and $YBO_3$:Tb, and a blue phosphor layer includes a phosphor material such as BAM:Eu.

The discharge cells 180 are filled with a discharge gas containing a mixture of Ne and Xe. While the discharge cells 180 are filled with the discharge gas, the front and rear substrates 111 and 121 are sealed and coupled to each other using a sealing member, such as frit glass, formed along a boundary of the front and rear substrates 111 and 121.

The operation of the PDP 100 configured as described above is as follows.

Plasma discharges that occur in the PDP 100 are largely classified into an address discharge or a sustain discharge. The address discharge occurs when an address voltage is supplied between the address electrodes 122 and the Y electrodes 132. Discharge cells, in which the sustain discharge will occur, are selected from the discharge cells 180 according to the address discharge.

Then, a sustain voltage is supplied between the X electrode 131 and the Y electrode 132 of the selected discharge cells 180. Since an electric field is concentrated in the first and second grooves 145 and 146 formed in the front dielectric layer 115, the discharge voltage is reduced. This is because a discharge path between the X and Y electrodes 131 and 132 is short, a strong electric field is generated and concentrates on the discharge path, and the densities of electric charges, charged particles and excited species are high. This phenomenon is more fully described later.

As the discharge gas that is excited during the sustain discharge drops to a lower energy level, the discharge gas generates ultraviolet rays. The ultraviolet rays excite the phosphor layers 126 formed in the discharge cells 180. When the exited phosphor layers 126 drop to a lower energy level, visible light is emitted and is transmitted through the front dielectric layer 115 and the front substrate 111 to form an image.

An increase in the luminous efficiency of the PDP 100 due to the first and second grooves 145 and 146 is described in detail below.

Figure 7A:
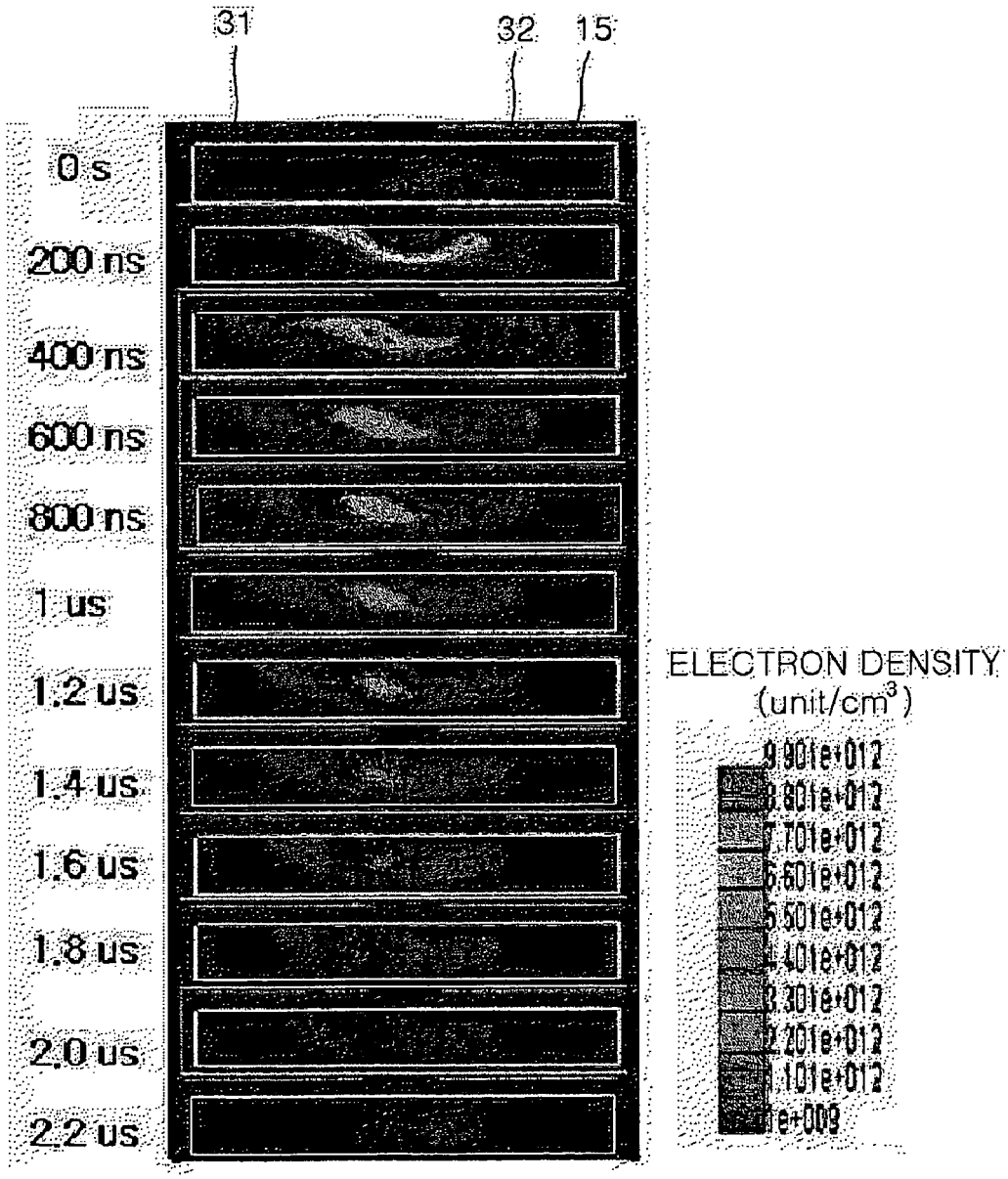
FIGS. 7A and 7B are respective images of simulated discharges of the modeled PDP of FIG. 1 and the modeled PDP of the present invention.
Figure 7B:
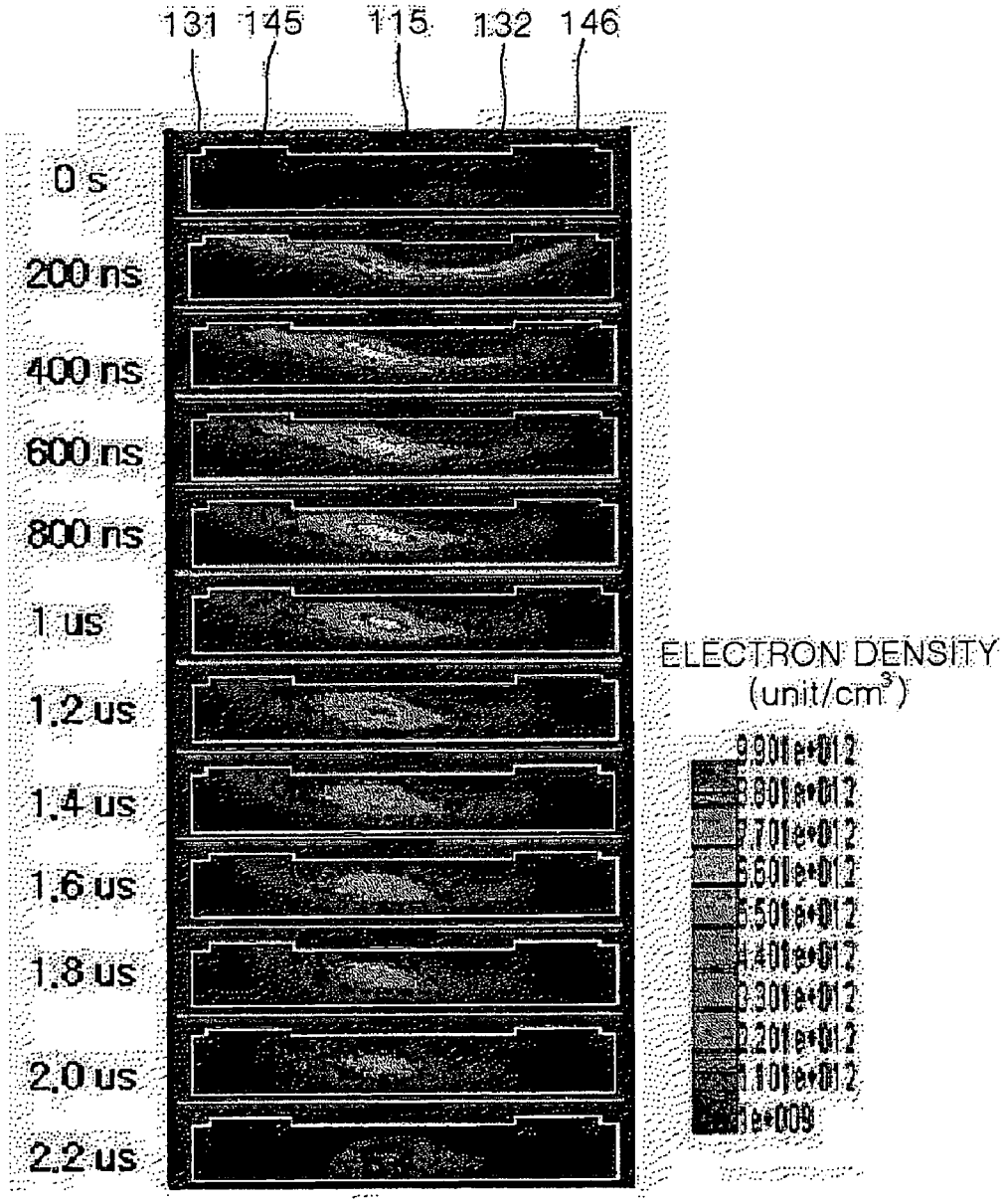

FIGS. 7A and 7B are images respectively illustrating simulated discharges of the modeled PDP 10 and the modeled PDP 100 of the present embodiment. FIG. 7A is a simulated photograph of the PDP 10, and FIG. 7B is a simulated photograph of the PDP 100 according to the present embodiment. FIGS. 7A and 7B illustrate electron densities in discharge cells for a predetermined period of time during a sustain discharge period. For simplicity of modeling, it was assumed that the PDP 10 was identical to the PDP 100 according to the present embodiment except that the PDP 100 further includes the first and second grooves 145 and 146. In the simulations, the respective distances G and S between the X electrodes 31 and 131 and the Y electrodes 131 and 132 were 110 μm and the sustain voltage was 230 V.

Referring to FIG. 7A, in the PDP 10, a discharge that was initiated between the X and Y electrodes 31 and 32 is spread toward a region outside the X and Y electrodes 31 and 32 over time. However, since the electron density in the region outside the X and Y electrodes 31 and 32 is very low, an active plasma discharge cannot be expected. Therefore, a long, highly efficient, discharge path cannot be effectively used. In particular, when the discharge path is short, the excited species of Xe included in the discharge gas cannot be efficiently used, which, in turn, hinders the luminous efficiency.

Referring to FIG. 7B in the PDP 100, according to the present embodiment, as the discharge spreads, the electron density within the first and second grooves 145 and 146 significantly increases. Therefore, the electric field is concentrated in the region of the front dielectric layer 115 having the first and second grooves 145 and 146. In addition, the luminous efficiency of the PDP 100 is significantly improved since discharge occurs on the highly efficient, long discharge path.

The potential difference, which facilitates spreading the discharge, between the X electrode 131 and the Y electrode 132 of each sustain electrode pair 112 of the PDP 100 according to the present embodiment is lower than the potential difference between the X and Y electrodes 31 and 32 of the PDP 10 due to the first and second grooves 145 and 146. Therefore, the PDP 100 of the current embodiment is more effective at spreading the discharge to both ends of the discharge cell 180. Therefore, the luminous efficiency of the PDP 100 can be improved using a long discharge path and a low sustain voltage. After the simulations, the conversion efficiency of vacuum ultraviolet rays of the PDP 100 was 26.47%, which is approximately 16% higher than the 22.77% of the PDP 10. The conversion efficiency of the vacuum ultraviolet rays is a percentage representation of the energy of the vacuum ultraviolet rays produced per unit energy consumed.

Figure 8A:
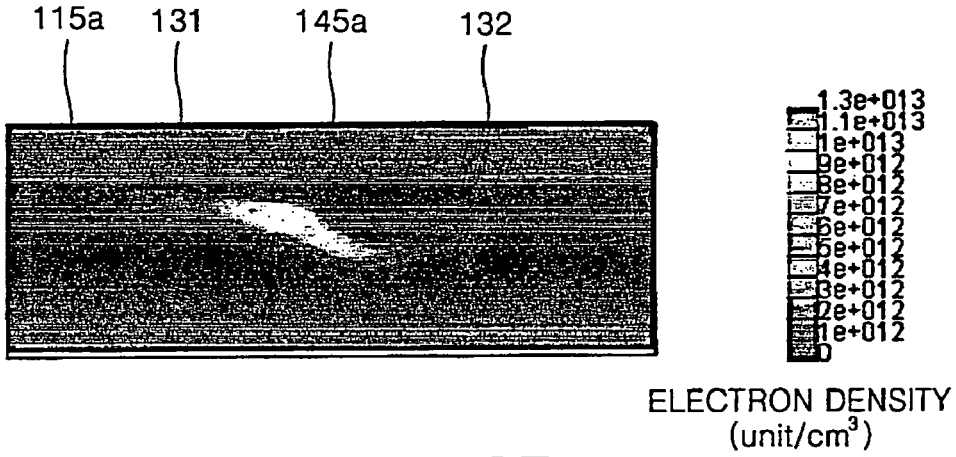
FIGS. 8A through 8C are respective simulation images of discharge paths in two comparative PDP examples and the PDP according to the present embodiment.
Figure 8B:
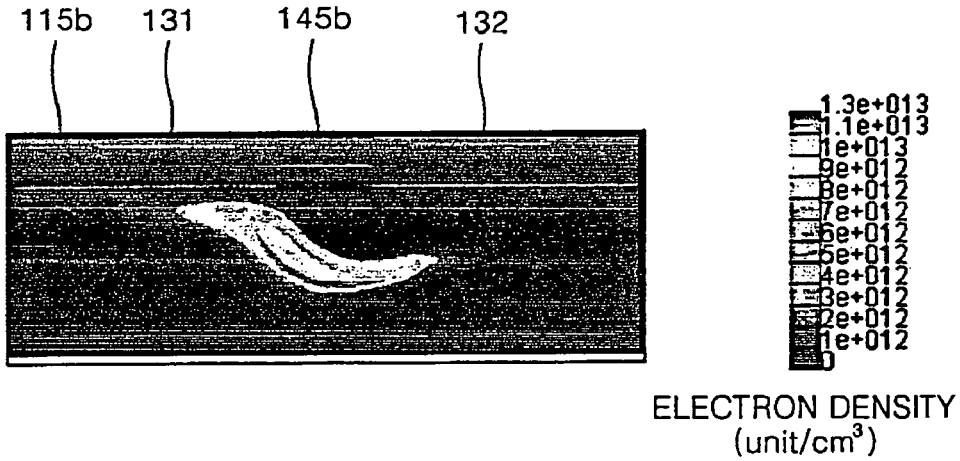
Figure 8C:
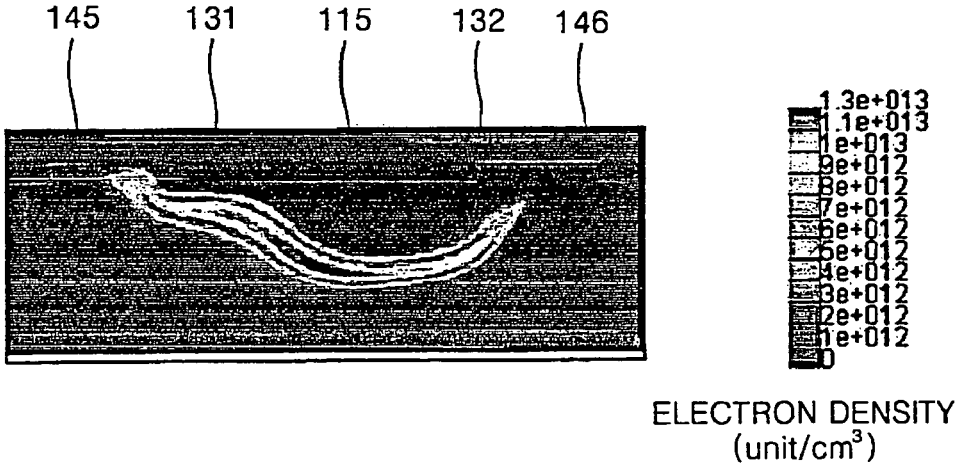

FIGS. 8A through 8C are simulation images illustrating, in detail, discharge paths in two comparative PDP examples and the PDP 100 according to the present embodiment, respectively. Simulations were conducted by modeling the present embodiment, and first and second comparative examples. The structures of PDPs in the first and second comparative examples are identical to that of the PDP 100 according to the present embodiment except for the formation of each of the grooves 145*a* and each of the grooves 145*b* that are formed respectively in front dielectric layers 115*a* and 115*b* in each discharge cell in the first and second comparative examples. In particular, the grooves 145*a* are formed to expose a front substrate in the first comparative example, shown in FIG. 8*a*, and the grooves 145*b* are formed to a predetermined depth of the front dielectric layer 115*b* in the second comparative example, shown in FIG. 8*b*.

FIGS. 8A and 8B are respective simulation images of the PDPs in the first and second comparative examples. Since an electric field is concentrated in each of the grooves 145*a* and 145*b* formed in the middle of the discharge cells, the discharge path is also concentrated in the middle of the discharge cells and is short. However, referring to FIG. 8C illustrating the simulation result of the PDP 100 according to the present embodiment, an electric field is concentrated not only in the middle but also in lateral regions of each of the discharge cells 180 due to the presence of the first and second grooves 145 and 146. Consequently, the discharge path in the PDP 100 is long. Therefore, the entire space of each of the discharge cells 180 can be used to generate discharge.

Figure 9:
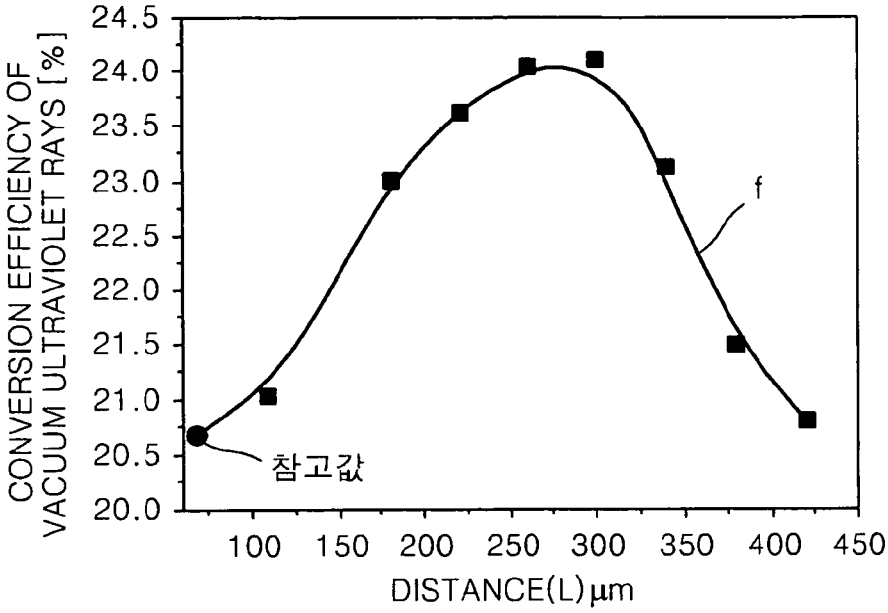
FIG. 9 is a graph of the conversion efficiency of vacuum ultraviolet rays of the modeled PDP of FIG. 2 and simulated while changing a distance between the first and second grooves.

FIG. 9 is a graph illustrating the conversion efficiency of the vacuum ultraviolet rays of the modeled PDP 100 of the present embodiment, simulated while changing a distance L between the first and second grooves 145 and 146, as shown in FIG. 4. In this simulation, the distance S between the X electrode 131 and the Y electrode 132 of each sustain electrode pair 112 was 110 μm, and the width of each of the X electrode 131 and the Y electrode 132 of each sustain electrode pair 112 was 155 μm. For comparison, the graph of FIG. 9 illustrates the conversion efficiency of the vacuum ultraviolet rays of the PDP 10, which does not include grooves in the front dielectric layer 15, as a reference value. The simulation started with the distance L between the first and second grooves 145 and 146 being 110 μm, which is equal to the distance S between the X electrode 131 and the Y electrode 132 of each sustain electrode pair 112. Then, the simulation was conducted while changing the distance L between the first and second grooves 145 and 146 seven times until the distance L between the first and second grooves 145 and 146 reached a maximum at 420 μm, which is equal to a distance between outer sides of the X electrode 131 and the Y electrode 132 of each sustain electrode pair 112. The results of the simulation are expressed as square marks on the graph of FIG. 9. A curve f illustrated in FIG. 9 is the result of curve fitting based on the simulation results.

According to the simulation results, as the distance L between the first and second grooves 145 and 146 increased, the conversion efficiency of the vacuum ultraviolet rays also increased. The distance L between the first and second grooves 145 and 146 peaked between 270 μm and 300 μm and then started to drop. When the distance L between the first and second grooves 145 and 146 was between 100 μm and 420 μm, the conversion efficiency of the vacuum ultraviolet rays of the PDP 100 of the present embodiment was higher than that of the PDP 10. It can be understood from the simulation results that the conversion efficiency of the vacuum ultraviolet rays of the PDP 100 is highest when each of the first grooves 145 extends laterally away from the outer side of each of the X electrodes 131 towards an outer edge of the discharge cells 180 and when each of the second grooves 146 extends laterally away from the outer side of each of the Y electrodes 132 towards the outer edge of the discharge cells 180. In other words, when the distance L between the first and second grooves 145 and 146 is equal to or greater than the distance S between the X electrode 131 and the Y electrode 132 of each sustain electrode pair 112 and is equal to or less than the distance between the outer ends of the X electrodes 131 and the outer ends of the Y electrodes 132, the PDP 100 of the current embodiment exhibits a far higher luminous efficiency than the PDP 10.

Therefore, it is obvious that the first and second grooves 145 and 146 help improve the conversion efficiency of the vacuum ultraviolet rays. In addition, since the amount of vacuum ultraviolet rays increase as the conversion efficiency of the vacuum ultraviolet rays increases, the luminous efficiency of the PDP 100 is enhanced accordingly.

Figure 10:
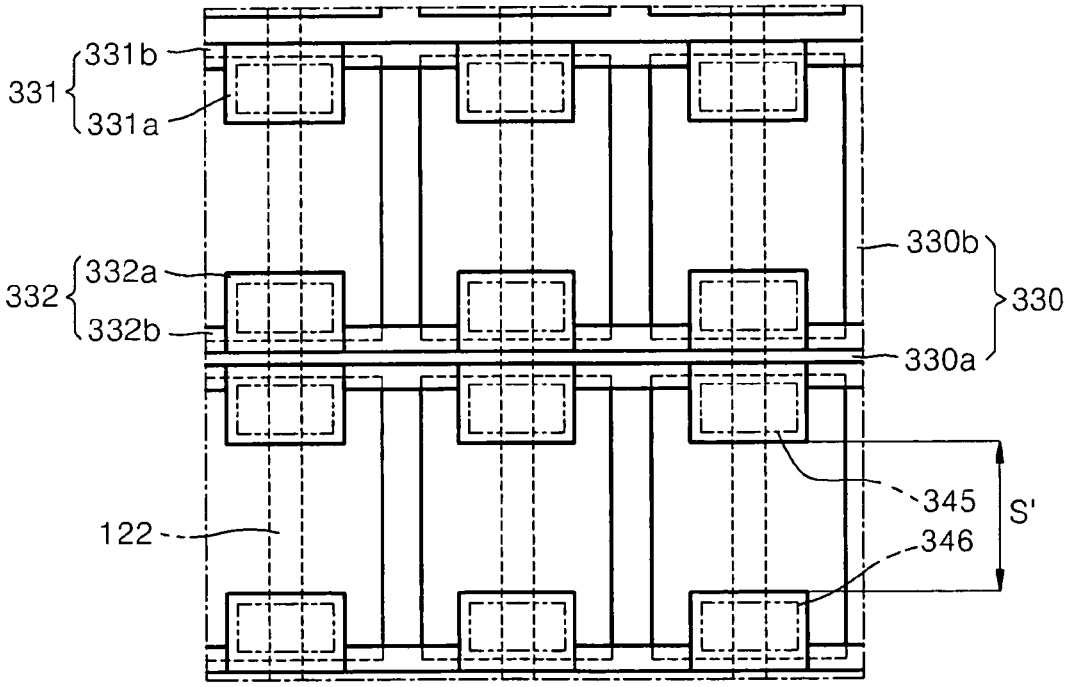
FIG. 10 is a view of a layout of a second modified version of the PDP of FIG. 2 according to another embodiment of the present invention.

FIG. 10 is a view of a layout of a second modified version of the PDP 100 according to another embodiment of the present invention.

The second modified version of the PDP 100 shown in FIG. 10 has a different arrangement of X and Y electrodes 331 and 332 from the embodiment of the PDP 100 shown in FIG. 2. Referring to FIG. 10, each of the X electrodes 331 includes a transparent electrode 331*a* and a bus electrode 331*b*, and each of the Y electrodes 332 includes a transparent electrode 332*a* and a bus electrode 332*b*. A portion of each of the bus electrodes 331*b* and a portion of each of the bus electrodes 332*b* correspond to each of first barrier-rib portions 130*a*. In addition, each first groove 345 correspond to a portion of each of the bus electrodes 331*b* and a portion of each of the transparent electrodes 331*a*, and each second groove 346 corresponds to a potion of each of the bus electrodes 332*b* and a portion of each of transparent electrodes 332*a* in each of discharge cells 180.

Considering that the bus electrodes 331*b* and 332*b* are generally formed of an opaque material, a portion of each of the discharge cells 180 occupied by each of the bus electrodes 331*b* and 332*b* is reduced in the second modified version of the PDP 100 according to the present embodiment. Therefore, an aperture ratio is sharply increased. In addition, since a distance S' between the X and Y electrodes 331 and 332 is large, a long discharge gap can be induced. In particular, the problem of an increase in the driving voltage due to the long gap discharge can be solved using the first and second grooves 345 and 346. Thus, the driving voltage can be reduced, while the overall luminous efficiency of the PDP is enhanced accordingly.

A PDP according to the present invention can have significantly improved luminous efficiency.

While the present invention has been particularly shown and described with reference to exemplary embodiments thereof, it will be understood that various modifications in form and detail can be made therein without departing from the spirit and scope of the present invention as defined by the following claims.

What is claimed is:

1. A Plasma Display Panel (PDP), comprising:

a rear substrate;

a front substrate facing the rear substrate;

a plurality of barrier ribs interposed between the front and rear substrates and partitioning a plurality of discharge cells;

a plurality of sustain electrode pairs arranged separate from each other on the front substrate facing the rear substrate, each pair of sustain electrodes including an X electrode and an Y electrode; and a front dielectric layer covering the sustain electrode pairs and having at least two grooves in each of the discharge cells;

wherein a distance between the X and Y electrodes of each sustain electrode pair is greater than a height of the barrier ribs, and wherein each of the grooves in each discharge cell corresponds to at least a portion of one of a corresponding X electrode and a corresponding Y electrode and extends laterally beyond an outer side of the one of the corresponding X electrode and the corresponding Y electrode toward a nearest outer edge of the discharge cell.

2. The PDP of claim 1, wherein the grooves correspond to the X and Y electrodes.

3. The PDP of claim 1, wherein two grooves are formed in each of the discharge cells, and the two grooves respectively correspond to each of the X electrodes and each of the Y electrodes.

4. The PDP of claim 3, wherein a distance between the two grooves of each discharge cell is equal to or greater than the distance between the X and Y electrodes of each sustain electrode pair and equal to or less than a distance between outer sides of the X and Y electrodes of each sustain electrode pair.

5. The PDP of claim 3, wherein each of the X electrodes comprises a bus electrode and a transparent electrode arranged on the bus electrode and each of the Y electrodes comprises a bus electrode and a transparent electrode arranged on the bus electrode, wherein the grooves correspond to the transparent electrodes.

6. The PDP of claim 3, wherein each of the X electrodes comprises a bus electrode and a transparent electrode arranged on the bus electrode and each of the Y electrodes comprises a bus electrode and a transparent electrode arranged on the bus electrode, wherein at least a portion of each of the grooves corresponds to each of the bus electrodes.

7. The PDP of claim 1, wherein the grooves correspond to each other in each discharge cell and are symmetrical to each other with respect to a virtual plane of symmetry arranged therebetween, and parallel to the X and Y electrodes of each sustain electrode pair.

8. The PDP of claim 1, wherein the distance between the X and Y electrodes of each sustain electrode pair is in a range between 110 μm and 260 μm.

9. The PDP of claim 1, wherein the discharge cells are rectangular, and the distance between the X and Y electrodes of each sustain electrode pair is in a range between ¼ and ½ the length of a long side of each of the discharge cells.

10. The PDP of claim 1, wherein the front dielectric layer comprises a Bi-based material.

11. The PDP of claim 1, wherein the front dielectric layer comprises $Bi_2O_3$.

12. The PDP of claim 11, wherein the front dielectric layer comprises $Bi_2O_3$, $B_2O_3$ and ZnO.

13. The PDP of claim 1, wherein the grooves are arranged intermittently in each of the discharge cells.

14. The PDP of claim 13, wherein the grooves have rectangular cross-sections.

15. The PDP of claim 14, wherein a long side of the cross-section of each of the grooves is in a range between 180 μm and 240 μm.

16. The PDP of claim 14, wherein a short side of the cross-section of each of the grooves is in a range between 80 μm and 120 μm.

17. The PDP of claim 1, wherein the barrier ribs respectively comprise first barrier-rib portions parallel to the sustain electrode pairs and second barrier-rib portions connecting the first barrier-rib portions.

18. The PDP of claim 17, wherein each of the X electrodes comprises a bus electrode and a transparent electrode arranged on the bus electrode and each of the Y electrodes comprises a bus electrode and a transparent electrode arranged on the bus electrode, wherein at least a portion of each of the bus electrodes corresponds to the first barrier-rib portions.

19. The PDP of claim 17, wherein each of the X electrodes comprises a bus electrode and a transparent electrode arranged on the bus electrode and each of the Y electrodes comprises a bus electrode and a transparent electrode arranged on the bus electrode, wherein the bus electrodes are separated from the first barrier-rib portions by a predetermined distance in a direction toward a center of the discharge cells.

20. The PDP of claim 1, further comprising:

address electrodes crossing the sustain electrode pairs and arranged on the rear substrate facing the front substrate;

a rear dielectric layer covering the address electrodes and the rear substrate; and phosphor layers arranged within each discharge cell.

* * * * *